United States Patent [19]

West

[11] Patent Number: 4,695,363

[45] Date of Patent: Sep. 22, 1987

[54] WAX CRYSTAL MODIFICATION USING DEWAXING AIDS UNDER AGITATED CONDITIONS

[75] Inventor: Theodore H. West, Sarnia, Canada

[73] Assignee: Exxon Research and Engineering Company, Florham Park, N.J.

[21] Appl. No.: 867,141

[22] Filed: May 27, 1986

[51] Int. Cl.[4] ..... C10G 73/04

[52] U.S. Cl. ..... 208/33

[58] Field of Search ..... 208/31, 33, 37, 38, 208/28; 196/14.5

[56] References Cited

U.S. PATENT DOCUMENTS

| | | | |
|---|---|---|---|
| 1,892,283 | 12/1932 | Manley | 208/38 |
| 2,229,658 | 1/1941 | Jenkins | 208/37 |
| 2,625,502 | 1/1953 | Backlund et al. | 208/38 |
| 3,393,144 | 7/1968 | Button et al. | 208/28 |
| 3,458,430 | 7/1969 | Henselman et al. | 208/33 |
| 3,475,321 | 10/1969 | Henselman et al. | 208/33 |
| 3,479,278 | 11/1969 | DeVault | 208/33 |
| 3,773,650 | 11/1973 | Hislop et al. | 208/33 |
| 3,775,288 | 11/1973 | Eagen et al. | 208/33 |
| 4,140,620 | 2/1979 | Paulett | 208/33 |
| 4,314,886 | 2/1982 | Ryan | 196/14.5 |
| 4,339,619 | 7/1982 | Onodera et al. | 570/183 |
| 4,354,003 | 10/1982 | Onodera et al. | 525/222 |
| 4,422,924 | 12/1983 | Onodera et al. | 208/33 |
| 4,439,308 | 3/1984 | Gudelis et al. | 208/33 |
| 4,441,987 | 4/1984 | Broadhurst | 208/33 |
| 4,451,353 | 5/1984 | Briens et al. | 208/33 |
| 4,460,453 | 7/1984 | Gudelis et al. | 208/33 |
| 4,461,698 | 7/1984 | Briens et al. | 208/33 |

*Primary Examiner*—Andrew H. Metz
*Assistant Examiner*—Glenn Caldarola
*Attorney, Agent, or Firm*—Joseph J. Allocca

[57] ABSTRACT

Wax crystals of improved morphology are produced by employing a dewaxing aid in an agitated solvent dewaxing environment, preferably an agitated indirect chilling solvent dewaxing environment, such as an agitated chiller, such as a scraped surface chiller which has been modified so that the scraper is not in contact with the internal wall of the chiller wherein a high degree of agitation is maintained by rotating the paddles to achieve a paddle tip speed of 25 to 400 ft./min. and the gap between the agitator tip and the inner wall of the vessel is about 0.5 to 40% of the internal diameter of the chiller. Agitation in agitated indirect chiller appratus has been shown to produce significantly improved feed filter rates and liquids/solids ratios when employed in conjunction with dewaxing aids in solvent dewaxing processes.

5 Claims, 2 Drawing Figures

WAX CRYSTAL MODIFICATION USING DEWAXING AIDS UNDER AGITATED CONDITIONS

DESCRIPTION OF THE INVENTION

The filter feed rate and liquid/solid ratio of solvent dewaxed oil are improved by conducting the lube oil solvent dewaxing process under conditions of agitation in indirect chilling means while employing dewaxing aids. By practicing such dewaxing aid assisted indirect chilling lube oil solvent dewaxing under agitated conditions, the quantity of dewaxing aid employed can be minimal, on the order of 0.01 to 1.0 weight percent active ingredient, based on waxy oil feed. The indirect chiller apparatus makes use of paddles, which preferably extend substantially the length of the chiller apparatus, to produce agitation in the chiller. These paddles must not touch the interior wall of the chiller since to do so results in scraping, which is detrimental to filter rate and liquid/solid performance. In the present invention the paddles are at least 0.05 inch to 5 inches away from the internal wall of the chiller, i.e., a gap of 0.05 to 5 inches exists between the tip of the paddle and the internal chiller wall. This gap is preferably 0.1 to 2 inches, most preferably 0.25 to 1 inch. Of course, the larger gaps can exist only in those units which have a correspondingly larger internal diameter. This gap, therefore, ranges from between about 0.5 to 40% of the chiller internal diameter, preferably about 1 to about 40% of the chiller internal diameter, most preferably about 2 to about 20% of the chiller internal diameter. These paddles are rotated so as to exhibit a tip velocity of between about 25 to 400 ft./min., preferably between about 50 to 250 ft./min., most preferably 50 to 100 ft./min., which for the purposes of the specification is deemed to be tangential fluid velocity in the region of crystallization. For example, when employing a chiller having a 5.25 inch internal diameter, paddles which exhibits a paddle to chiller wall gap of about 0.5 inch are rotated at speeds between about 50 to 200 rpm. Preferably, in such 5.25 inch system paddle speeds of about 100 rpm are employed, as operation in this agitation region produces the best results when one considers both feed filter rate and liquid/solid ratio as a total entity. These rotational speeds correspond to fluid velocities of between about 50 to 250 feet/minute in the crystallization region near the chilling surface, where the flow generated by a rotating paddle is mainly tangential. This additional agitation component, when added to the longitudinal flow due to fluid velocity through the vessel will produce an excellent environment for good heat transfer, optimum dewaxing aid-wax interaction and the formation of dense, spherical crystal structures. The paddle rotational speed needed to achieve a tangential fluid velocity of between about 25 to 400 feet/minute, preferably between about 50 to 250 feet/minute, by means of a rotating agitator means in an indirect chiller with the agitator not touching the walls of the chiller can be easily determined by practitioners for any size apparatus. The determination of the range of distance (i.e., the size of the gap) between the agitator blade tip and interior wall needed to insure meeting this fluid velocity in the region of crystallization near the chiller wall within a given range of tip velocities regardless of sizing of chiller equipment is similarly within the skill of the practitioner with this teaching of the importance of this tangential fluid velocity of between about 25 to 400 feet/minute, preferably between about 50 to 250 feet/minute, most preferably between about 50 to 100 feet/minute before him.

The waxy oil feeds which may be effectively dewaxed employing the process of the present invention include any waxy hydrocarbon lube oil feedstream, preferably a waxy petroleum lubricating oil, speciality oil, turbine oil, white oils, refrigerator oils, etc. These waxy hydrocarbon oil feedstocks can come from any natural or synthetic source, including coal oils, tar sands oils, shale oils, etc. The natural petroleum oil stocks can be any naphthenic or paraffinic oil, such as oils obtained from Aramco, Kuwait, the Panhandle, North Louisiana, Western Canada, South Texas, Tia Juana, North Sea, North Slope, etc. Typically, the waxy hydrocarbon lube oil feedstock will have a boiling range within the broad range of about 500° F. to about 1,300° F. The preferred oil stocks are the lubricating oil and specialty oil fractions boiling within the range of 550° F. to 1,200° F. (atmospheric).

Solvent dewaxing, as the name implies, employs a solvent to both dilute the oil and as an aid in wax precipitation. This solvent can be selected from any of the known, readily available solvents. Representative of such solvents are the aliphatic ketones having from 3 to 6 carbon atoms, such as acetone, methylethyl ketone (MEK), methylisobutyl ketone (MIBK), and mixtures thereof; the lower molecular weight, normally gaseous, liquefied hydrocarbons, such as methane, ethane, propane, butane, propylene, butylene, etd. or mixtures of solvents typically identified and described as autorefrigerative solvents with the aforementioned ketones, such as propylene, MEK, mixtures of the aforementioned ketones with $C_6$–$C_{10}$ aromatic hydrocarbons, such as MEK/toluene. Further, halogenated hydrocarbons of lower molecular weight, such as $C_1$–$C_4$ halogenated hydrocarbons, may be employed, as exemplified by $C_1$–$C_4$ chlorinated hydrocarbons (i.e., dichloromethane, dichloroethane, tetrachloropropane, etc.) may also be employed. Ethers may also be employed as dewaxing solvents, such as methyl tertbutyl ether (MTBE). The preferred solvents are mixtures of MEK/MIBK, MEK/toluene, propylene/acetone.

The process will be conducted under typical solvent dewaxing conditions, including chilling to a wax filtration temperature in whatever range satisfies the requirements of the practitioner and is compatible with the oil being employed. Typically, waxy oils are chilled to a temperature about 10° to 30° F. below the finally desired oil cloud point temperature. Consequently, if an oil with a cloud point of about −10° F. is desired, the oil will be chilled to a temperature, called the wax filtration temperature, of between about −20° F. to −40° F., depending on the oil and solvent employed. Chilling will be at a relatively uniform rate so as to minimize the effects of shock chilling. Consequently, chilling rates on the order of 1° to 20° F./minute will be employed.

The waxy lube oil feed is introduced at a temperature above its cloud point into an indirect chilling apparatus, such as a double tube chiller. The space between the inner and outer pipes is the space through which a chilling medium is passed. In such indirect chilling apparatus the oil, with or without solvent predilution, preferably with solvent predilution, is introduced into the central pipe in which an agitated environment is maintained by means of a centrally rotating shaft upon which are located paddles, blades, turbine plates, propellers, etc., in other words, means suited for establishing a level of agitation in the central pipe. As previously stated, agitation can be achieved by the use of propellers, blades or paddles which effectively sweep the cold exchanger wall surfaces and which are uniformly distributed to sweep at least 10% of the wall, preferably about 50% of the wall surface, and most preferably at least 90% of the wall surface. A typical design would be similar to a conventional scraped surface exchanger where the scraper blades are moved away from the wall providing greater than 90% sweeping of the cold exchanger surfaces. These agitator means, i.e., paddles, blades, propellers, etc., are sized so as not to touch the interior wall of the chiller. Touching would result in a scraping action, which has been found to be detrimental to filter rate and liquids/solids ratios on increasing the speed of rotation of the scraper, as compared to the present invention where increased agitation levels in combination with the use of added dewaxing aid has been found to very favorably affect feed filter rate and liquid/solids ratios. In this manner, the contents present in the central pipe are indirectly chilled by the chilling medium present in the inner and outer pipes. The feed may be introduced into the central pipe undiluted with dewaxing solvent, the dewaxing solvent being added incrementally along the length of the chiller. This added solvent should be at about the same or a slightly lower temperature than the waxy feed at the point of introduction. Alternatively, and preferably, the waxy feed is prediluted with from 1 to 10 volumes of solvent prior to being introduced into the central pipe, more preferably 2 to 5 volumes. This predilution alternative is the preferred mode of operation. The agitation means within scraped surface chiller devices must not be in its "as designed" configuration, that is, the scraper blades must not be touching the interior walls of the chiller pipe, but must be adjusted so as not to be in contact with the wall, but just sweep past the interior wall at some specific distance from the wall. This configuration is necessary as it eliminates the possibility of the precipitated wax being physically crushed by the blades as the blades sweep past the interior wall, as compared to the configuration in which the blades are in physical contact with the interior chiller walls. It is also advantageous to move the blades away from the interior wall as this facilitates increasing the rotational speed of the sweeper blade assembly without the need to overcome blade/-wall friction or drag.

BACKGROUND OF THE INVENTION

Figure 1:
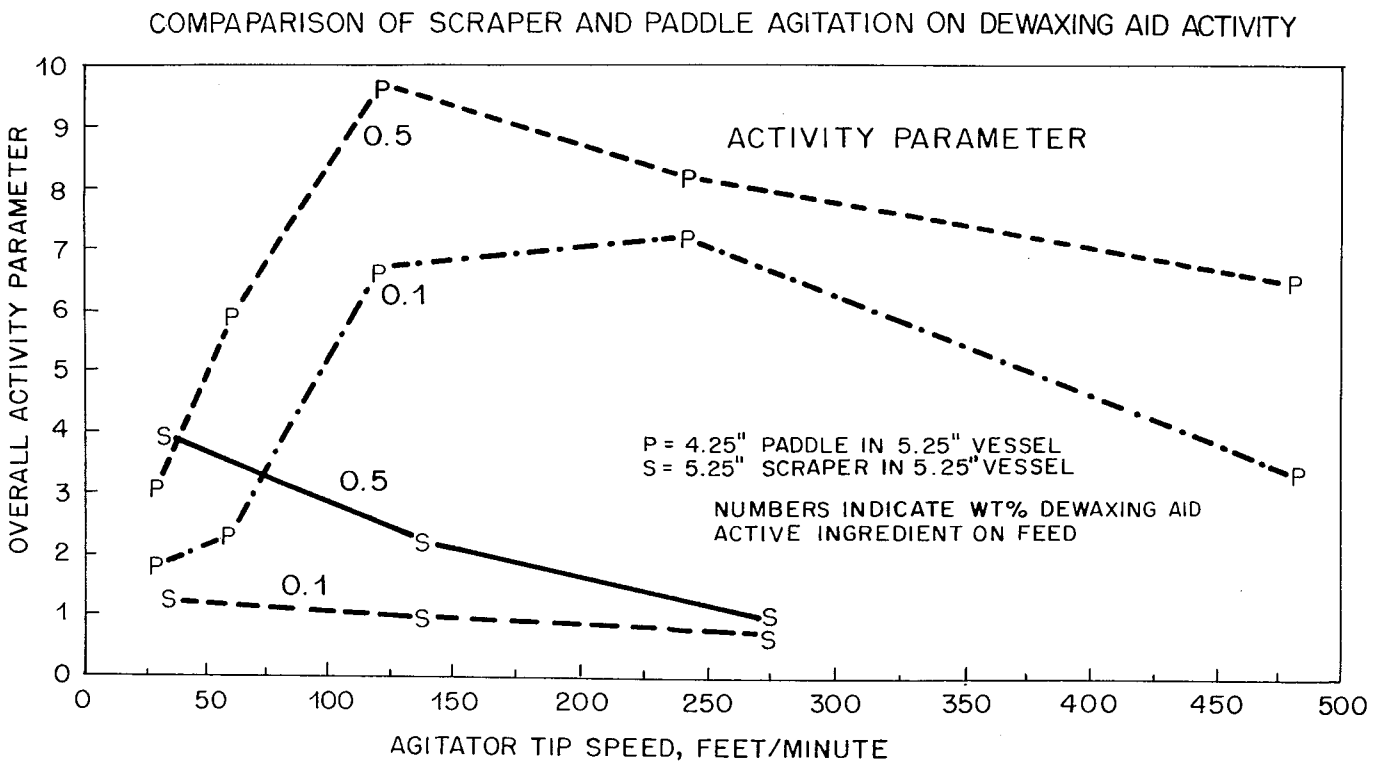
FIG. 1 shows the improvement in dewaxing aid performance (at similar does levels) when a gapped agitator operates at a high agitation tip speed, as compared to a standard scraper also operating at high rotational speeds.
Figure 2:
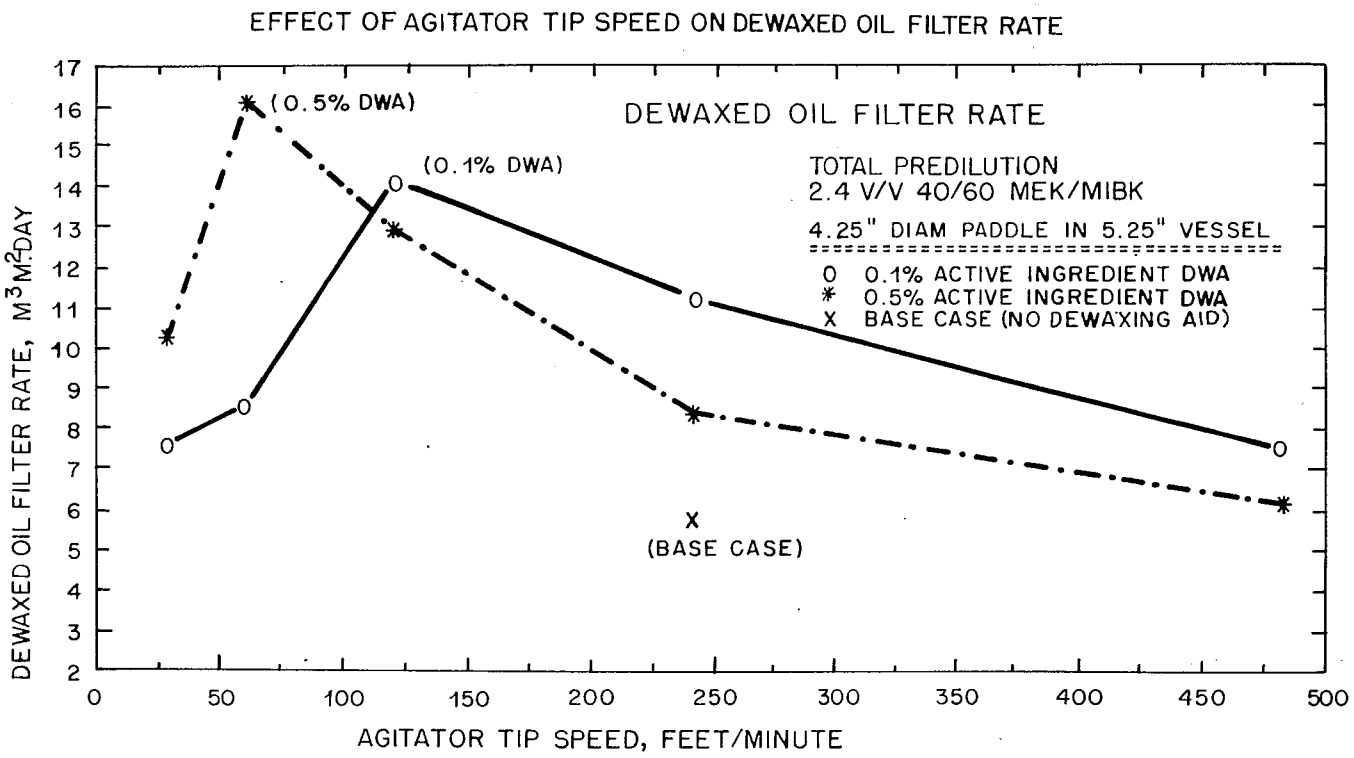
FIG. 2 shows that increasing agitator speed alone which, produces some benefit, is not as significant as when agitator speed is increased when a dewaxing aid is used.

In the past, wax precipitation was conducted under conditions of low or no agitation. This procedure was followed since it was believed that precipitation under conditions of high agitation would result in the formation of fine wax particles which could clog the liquid-solid separators. The typical wax precipitation technique employed scraped surface chillers. In such a unit, a waxy oil and a dewaxing solvent are premixed at a temperature sufficient to effect complete solution of the oil and wax. If necessary, the waxy oil is heated (either prior to or after addition of solvent) to insure complete solution of the wax contained therein.

The solution is then indirectly cooled at a uniformly slow cooling rate, e.g., 1° F. to 5° F. per minute, under conditions which avoid substantial agitation of the solution during precipitation of the wax. Because of fouling of the exchanger wall in the indirectly cooled heat exchangers due to wax deposition on the exchanger surface, scrapers are employed to remove the wax. However, because of the physical crushing of the wax crystals formed on the chiller wall by the action of the scrapers, non-uniform crystal growth occurs which results in slow filtration rates and large amounts of occluded oil in the wax.

The DILCHILL$^R$ (DILCHILL is a registered service mark of Exxon Research and Engineering Company) process was developed so as to overcome the inherent limitations and disadvantages of scraped surface chilling dewaxing. In the DILCHILL process, cooling is accomplished in a slaged tower. The waxy oil is removed through the tower, while cold solvent is injected along the tower directly into a plurality of the stages (either some or all of the stages have cold solvent injected into them). The cold solvent injection is accompanied by a high degree of agitation in at least a portion of the stages containing waxy oil and solvent so as to insure substantially instantaneous mixing of the cold solvent and waxy oil. Chilling is conducted to a temperature of between about 0$^F$ and 50° F. A substantial portion of the wax is precipitated from the waxy oil under these conditions of cold solvent injection and high agitation. The DILCHILL process is described in greater detail in U.S. Pat. No. 3,773,650.

A modification of the DILCHILL process is presented in U.S. Pat. No. 3,775,288. In the modified DILCHILL process, cooling by means of cold solvent injection and high agitation is conducted to a temperature greater than the temperature at which the wax is separated from the oil, i.e., the wax separation temperature, but generally less than about 40° F. above said separation temperature, and preferably less than about 35° F. above said separation temperature, thereby precipitating at least a portion of the wax from the waxy oil. This oil-solvent-wax slurry is then withdrawn from the DILCHILL chilling zone and introduced into a second chilling zone wherein it is cooled to the wax separation temperature, thereby precipitating a further portion of the wax from the waxy oil. Cooling rates in this zone are in the range of 5° F.–20° F. per minute.

This modification is practiced so as to avoid employing the large volumes of cold solvent which would otherwise be necessary to reduce the temperature of the oil-solvent-wax slurry all the way down to the wax separation temperature. In this embodiment, the second chilling zone may incorporate any conventional cooling process, such as scraped surface chilling, autocelrigeration and the like; however, scraped surface chilling is preferred. In scraped surface chillers the partially cooled oil-solvent-wax slurry is indirectly cooled to the wax separation temperature without the addition of more solvent. The scrapers are used to remove any wax which adheres to the walls of the chillers. A disadvantage of the scraped surface chiller in this embodiment is the same as that encountered when employing scraped surface chillers as the sole cooling unit. The scrapers physically crush the wax crystals formed on the chiller wall, thereby reducing the wax filtration rates and increasing the amounts of occluded oil in the wax.

U.S. Pat. No. 4,140,620 to Paulett described an incremental dilution dewaxing process wherein a lubricating oil stock, at a temperature above its cloud point, is cooled in a cooling zone with vigorous agilation to a temperature below its cloud point and then further cooled with minimum agitation and incremental solvent addition to its final temperature, followed by filtration for the removal of wax. Rapid stirring is provided during the early part of the cooling period. The cooling zone is described as being a conventional, double wall heat exchanger provided with means for agitating the oil during cooling by more rapid rotation of the scrapers. The base oil stock is diluted with solvent during the initial period of agitated chilling. The major portion of the solvent is added to the system after the initial wax crystals have formed, i.e., after the temperature of the oil base stock, with or without dilution, has reached a temperature slightly below the cloud point of the waxy petroleum fraction. From the figure in the patent it is seen that the cooling zone comprises a double wall chiller wherein the waxy oil feed is introduced into the inner zone with cold filtrate supplied to the outer jacket of the chiller, with increased agitation being provided by increased rotational speed of the scrapers.

It is clear that the bulk of the solvent is added after the initial high agitation cooling and before or during the low or no agitation final cooling steps.

The concept of using dewaxing aids in solvent dewaxing processes has also been addressed in numerous patents.

U.S. Pat. Nos. 4,354,003 and 4,422,924, incorporated herein by reference, teach a dewaxing aid and that solvent dewaxing is improved by using said dewaxing aid, which dewaxing aid comprises a mixture of (a) an alpha-olefin polymer having an average molecular weight of from about 10,000 to 1,000,000 and a wide molecular weight distribution exceeding the range of from about 10,000 to 1,000,000, but falling within the range of from about 2,000 to 3,000,000 wherein the alpha-olefin polymer is a homopolymer made up of a $C_{10}$ to $C_{25}$ alpha olefin monomer or is a copolymer made up of a monomer mixture comprising more than 50 weight percent of at least two $C_{10}$ to $C_{25}$ alpha olefin monomers, having a melt index greater than 1.8 g/10 min.; and (b) an olefin vinyl acetate copolymer having a vinyl acetate content of from about 15 to 40 weight percent an an average molecular weight of from about 50,000 to 1,000,000 and a melt index greater than 2 g/10 min.

In U.S. Pat. No. 4,339,610, incorporated herein by reference, it is taught that solvent dewaxing is improved by using a polymeric dewaxing aid which comprises a condensation product of naphthalene and chlorinated wax, having an average molecular weight ranging from about 20,000 to 500,000 and a molecular weight distribution exceeding the range of from about 10,000 to 1,000,000.

In U.S. Pat. No. 4,451,353, incorporated herein by reference, it is taught that solvent dewaxing waxy hydrocarbon oil distillates is improved by using a dewaxing aid which comprises a mixture of (a) polyalkyl acrylate having alkyl group side chain lengths of from 10–26 carbons (excluding branching); and (b) an n-alkyl methacrylate polymer having alkyl group side chain lengths of from 10–20 carbons, excluding branching. Component (a) typically has a number average molecular weight of from 3,000 to 500,000, while component (b) has a number average molecular weight of from 5,000 to 200,000. The combination (a) plus (b) may be employed in a weight ratio within the range from about 1/100 to 100/1 at an aid dose level ranging from about 0.01 to 1.0 weight percent active ingredient.

In U.S. Pat. No. 4,460,453, incorporated herein by reference, it is taught that solvent dewaxing of bright stock is improved by using a dewaxing aid comprising (a) a poly di-alkyl fumarate/vinyl acetate copolymer in combination with (b) poly alkyl (meth-) acrylate polymers. Component (a) has a number average molecular weight of about 1,000 to 100,000 and possesses alkyl side chains of from $C_{16}$–$C_{24}$+ in length excluding branching with a pendant side chain length of predominantly (>50%) $C_{20}$. The polyalkyl (meth-) acyrlate is the polymeric ester of aliphatic alcohols having groups 10 to 20 carbons in length, excluding branching (pendant side chain length predominantly (>50%) $C_{14}$ and lower) and acrylic or (meth-) acrylic acid (preferably melhacrylic acid) and possesses a number average molecular weight of at least 5,000. The solvent dewaxing processes benefited by the use of the present combination are those using standard, normally liquid solvents, such as $C_3$ to $C_6$ ketones, aromatic hydrocarbons, halogenated hydrocarbons and mixtures thereof. The waxy hydrocarbon oil dewaxed is a bright stock. The dewaxing aid combination may be used at a dose level of from about 0.005 to 5 weight percent active ingredient at a component A/B ratio of about 4/1 to 1/100.

U.S. Pat. No. 4,439,308, incorporated herein by reference, teaches solvent dewaxing Bright stock waxy raffinale oil employing a dewaxing aid, which dewaxing aid is a mixture of (a) poly-di-alkyl fumarate/vinyl acetate copolymers; and (b) a wax-naphthalene condensate. The dewaxing aid mixture is a mixture of (a) poly-di-alkyl fumarate/vinyl acetate copolymer, having a number average molecular weight of about 1,000 to 100,000, preferably 5,000 to greater, possessing alkyl side chains of from $C_{16}$–$C_{24}$+ in length (excluding branching) with an average pendant side chain length of predominantly (>50%) $C_{20}$; and (b) a wax-naphthalene condensation product having a number average molecualr weight of about 1,000 and greater. The combination (a) plus (b) may be employed in a weight ratio within the range from about 45/55 to 1/100, preferably about 1/3, and an aid dose level ranging from about 0.005 to 2.0 weight percent, preferably 0.01 to 0.2 weight percent active ingredient.

U.S. Pat. No. 4,461,698, incorporated herein by reference, teaches solvent dewaxing processes for dewaxing waxy hydrocarbon oil distillates employing a dewaxing aid, which dewaxing aid is a mixture of (a) a poly-dialkylfumarate/vinyl acetate copolymer; and (b) a wax-naphthalene condensation product. Component (a) has pendant alkyl side chain groups of from 16 to 30 carbon atoms in length (excluding branching) with an average pendant side chain carbon length of predominantly (>50%) $C_{22}$. Component (a9) has a number average molecular weight of from about 1,000 to 100,000, preferably greater than about 5,000. Component (b) has a number average molecular weight of at least about 1,000. The combination (a) and (b) may be employed in a weight ratio A/B within the range of from about 1/10 to 20/1 and at an aid dose level ranging from about 0.005 to 2.0 weight percent.

In each of the above cases directed to practicing solvent dewaxing employing a dewaxing aid the agitation conditions are either undefined or agitation was provided by employing rotating scrapers (as in a scraped surface chiller) which were rotating at about either 12 rpm or 28 rpm.

U.S. Pat. No. 4,441,987 describes dewaxing using an agitated chiller to chill solvent/oil-wax slurries to effect dewaxing. Agitation expressed in terms of Reynolds numbers is on the order of 1,000 to 1,000,000. The patent is silent as to the use of any dewaxing aid.

U.S. Pat. No. 3,393,144 describes a dewaxing process which is benefited by using an added dewaxing aid in a high agitation, indirect chilling environment for fuels dewaxing. Agitation is on the order of 250 to 1,000 rpm and is recited in the Examples. In the Examples feed filter rate improves on going to higher impeller speeds (rpm).

PRESENT INVENTION

In the present invention it has been discovered that feed filter rate is maximized in a solvent dewaxing environment by practicing the dewaxing in the presence of a dewaxing aid in indirect chilling means under conditions of agitation. From between about 0.01 to 1.0 weight percent dewaxing aid active ingredient may be employed, preferably between about 0.01 to 0.5 weight percent dewaxing aid active ingredient based on waxy oil feed. Any of the dewaxing aids common in the trade may be employed, such as those listed in the above-identified patents, as well as in U.S. Pat. Nos. 3,475,321 and 3,479,278 to Henselman, et al. From 1 to 10 V/V dilution solvent are employed, preferably with at least part of the solvent being added to the waxy feed prior to the feed being introduced to the dewaxing zone. From 0.2 to 2 volumes of solvent per volume of waxy feed is preferably used as the predilution solvent. Total solvent employed (predilution plus dilution) is preferably in the 1 to 8 V/V range.

The dewaxing environment is an agitated environment. Agitation can be achieved, for example, by employing indirect chillers within which is a rotating shaft upon which are affixed paddles or blades extending substantially the entire internal length of the chiller unit, rotating at a paddle tip velocity of about 25 to 400 ft./min. The system for practicing this invention uses rotating paddles having a diameter only slightly smaller than the chilling vessel, the gap between the paddle tip and the chiller internal wall being from about 0.5 to about 40% of the chiller internal diameter, preferably 1 to 15% of the chiller internal diameter, most preferably about 2% to about 20% of the chiller internal diameter. This configuration imparts additional agitation, which is mainly radial and tangential close to the chiller wall in the critical region where crystallization is initiated. The data indicate a sensitivity and critical agitation limitation of about 50 to about 250 feet per minute fluid velocity near the chilling surface. With this present teaching before him, the practitioner can easily determine how to achieve such levels of fluid velocity for any size apparatus. For example, in a 12" vessel with an 11" agitator a tip speed of 100 ft./min. would require an agitator speed of 35 rpm.

$$\frac{\text{Tip Speed}}{\text{Circumference}} = \text{RPM}$$

Indirect chilling devices are benefited most by the practice of the present invention. Practicing the present invention with direct chilling dewaxing procedures does not result in the same, if any, benefit.

A single number, called the activity parameter, is suggested as a convenient measure of crystallization performance. This number, which is the feed filter rate in $m^3/m^2$ day divided by the wax cake liquids/solids, increases in magnitude as dewaxing performance improves. Typical activity parameters are summarized below in Table II for a 600 neutral feedstock dewaxed under lab-simulated surface chilling (comparing scraped surface chilling and agitated surface (blades not touching the walls) conditions and DILCHILL conditions.

TABLE I

Feed
(600N oil) Typical Properties
Feed Cloud, °C. 51
Dist. Range, °C. 393 to 582
Viscosity cSt @100° C. 9.56
R. I. @75° C. 1.4596
API Gravity 28.8
Dewaxing Aid
Component 1 - (25 Wt. % as received)
A dialkylfumarate vinyl acetate copolymer made from a mixture of 70% $C_{22}$, 15% $C_{20}$ and 15% $C_{18}$ alcohols.
Molecular Weight (by GPC)
Weight Average 8,600
Number Average 61,000
Component 2 - (75 Wt. % as received)
Acryloid 144 (Rohm and Haas Company)
A polyalkyl methacrylate polymer made from a mixture of 4% $<C_{12}$, 7% $C_{14}$, 39% $C_{16}$, 45% $C_{18}$, 5% $>C_{20}$ alcohols.
Molecular Weight (by GPC)
Weight Average 33,000
Number Average 206,000
Predilution Conditions:
2.4 v/v 40/60 MEK/MIBK @60° C.; Filter @−10 C.
Incremental Dilution Conditions:
0.6 v/v @60° C.
0.7 v/v @35° C.
0.7 v/v @50° C.
0.4 v/v @−10° C.
Filter @−10° C.

Chilling was performed using externally chilled equipment. The waxy oil-solvent-dewaxing aid slurry was formed from the cloud point (about 60° C.) down to the filter temperature (about −10° C.). External bath temperature was about 10° C. below the slurry temperature. Volumes of solvent (as indicated above) were added during the chilling as the slurry reached the recited temperature using the external chilling. Final external bath temperature was about −20° C.

TABLE II

| Dewaxing Aid Wt.% Active Ingredient | Base Case (0) | 1.0 | 0.5 | 0.1 | Impeller Speed RPM | FPM | Impeller Diameter |
|---|---|---|---|---|---|---|---|
| | Activity Parameters | | | | | | |
| Scraped Surface Incremental Dilution | 0.5 | 4.3 | 2.5 | 1 | 24 | 33 | 5.25 |
| Scraped Surface Predilution | 0.65 | 5.5 | 4.0 | 1.2 | 24 | 33 | 5.25 |
| Agitated Surface Chilling Incre- | 1.0 | | 6.7 | | 200 | 223 | 4.25 |

TABLE II-continued

| Dewaxing Aid Wt.% Active Ingredient | Base Case (0) | 1.0 | 0.5 | 0.1 | Impeller Speed RPM | FPM | Impeller Diameter |
|---|---|---|---|---|---|---|---|
| | Activity Parameters | | | | | | |
| mental Dilution | | | | | | | |
| Agitated Surface Chilling | 1.5 | | 8.2 | 7.2 | 200 | 223 | 4.25 |
| Predilution DILCHILL | 2.4 | | 0.5 | | 1000 | 524 | 2 |

FPM is fluid velocity at the impeller tip.
Surface Chiller Vessel diameter = 5.25"
DILCHILL Vessel Diameter = 6"

The data show that both the total predilution and increased agitation contribute to the significant improvement in dewaxing aid activity at low doses with agitation being the prime variable. This suggests that the controlling limits are the magnitude of the turbulence produced in the system, a function of average slurry viscosity, slurry flow rate and agitator speed.

Additional experiments were carried out under total solvent predilution conditions (described above) using 2.4 V/V on feed of a 40/60 V/V mixture of MEK/-MIBK. The slurry was chilled at about 3° C. per minute using either a rotating scraper or rotating paddle. The scraper simulates a plant spring loaded scraper, whereas the paddle simulates the same equipment configuration with the scrapers removed from the wall to produce about a ½" scraper tip-to-wall gap.

Filtration performance is significantly improved for the agitated surface chilling unit when dewaxing aid is used as shown by the comparison data above and in Tables III and IV. The best overall performance considering both feed filter rate and liquids/solids in agitated chiller apparatus is achieved at 0.5% dewaxing aid at 100 rpm, which for the 5.25 inch internal diameter indirect chiller corresponds to a paddle tip-fluid velocity of 111 ft./min. (relative activity parameter 14.6). However, at 400 rpm, which corresponds to a paddle tip-fluid velocity of 445 ft./min., while extremely low liquids/solids of 1.2 is demonstrated, feed filter rate declines. The ability to reduce the dewaxing aid dosage to 0.1 weight percent and maintain relative activity parameter above 10 are shown, compared to the maximum activity parameter of 8.5 at 1.0 weight percent aid dosage using conventional scraped surface equipment (see Table II, 25 rpm at 1.0 weight percent aid dose).

FIG. 1 demonstrates the significant improvements in activity parameters for the paddle over the scraper operating at similar rpm in identical systems employing the data from Tables III and IV.

The advantages of this invention are, therefore, seen to be:

1. Low dewaxing aid dosages;
2. Low apparent slurry viscosities;
3. High feed filter rates;
4. Dense spherical wax structures with an absence of fines;
5. Low cake liquids/solids;
6. Reduced solvent volumes; and
7. Higher dewaxed oil yields.

TABLE III

EFFECT OF SCRAPER SPEED ON DEWAXING PERFORMANCE OF 600 N OIL

| % Dewaxing Aid Active Ingredient Wt. % | 0 | | 0.1 | | | 0.5 | | | 1.0 |
|---|---|---|---|---|---|---|---|---|---|
| Scraper, 5.25" (diameter) | | | | | * | | | | |
| Speed | | | | | | | | | |
| RPM | 25 | 24 | 100 | 200 | 24 | 24 | 100 | 200 | 24 |
| Ft/Min Fluid Velocity | 33 | 33 | 138 | 275 | 33 | 33 | 138 | 275 | 33 |
| Filter Rates $m^3/m^2 \cdot day$ | | | | | | | | | |
| Feed | 5.5 | 8.6 | 6 | 4.5 | 10.8 | 14.1 | 7.3 | 4.2 | 15.9 |
| Dewaxed Oil | 2.5 | 5 | 4 | 3.1 | | 11 | 5.6 | 3.2 | |
| Liquids/Solids | 8.4 | 7 | 6.5 | 6 | 3.4 | 3.6 | 3.25 | 4.3 | 2.9 |
| Activity Parameter | 0.66 | 1.23 | .93 | .75 | 3.2 | 3.9 | 2.2 | .96 | 5.5 |
| Relative Activity Parameter | 1 | 1.8 | 1.4 | 1.1 | 4.9 | 5.9 | 3.3 | 1.5 | 8.5 |
| Dewaxed Oil Yield, Wt. % | 45.5 | 57.6 | 67.2 | 69.8 | — | 77.9 | 76.9 | 75.9 | — |

Data for 5.25" diameter scraper operating in 5.25" diameter surface chilled vessel.
*This run was conducted under incremental dilution conditions.

TABLE IV

EFFECT OF PADDLE AGITATION ON DEWAXING PERFORMANCE OF 600 N OIL

| % Dewaxing Aid Active Ingredient Weight % | 0 | | | 0.1 | | | | | 0.5 | | |
|---|---|---|---|---|---|---|---|---|---|---|---|
| Agitator (4.25" diameter) | | | | | | | | | | | |
| Speed | | | | | | | | | | | |
| RPM | 200 | 25 | 50 | 100 | 200 | 400 | 25 | 50 | 100 | 200 | 400 |
| Ft/Min. | 223 | 28 | 56 | 111 | 223 | 445 | 28 | 56 | 111 | 223 | 445 |
| $m^3/m^2$ day | | | | | | | | | | | |
| Feed | 10 | 14.2 | 15.4 | 18.7 | 14.6 | 9.9 | 13.6 | 20.8 | 16.5 | 10.7 | 7.9 |

TABLE IV-continued

EFFECT OF PADDLE AGITATION ON DEWAXING PERFORMANCE OF 600 N OIL

| % Dewaxing Aid Active Ingredient Weight % | 0 | | | 0.1 | | | | | 0.5 | | |
|---|---|---|---|---|---|---|---|---|---|---|---|
| Dewaxed Oil | 5.8 | 7.6 | 8.5 | 14.1 | 11.2 | 7.5 | 10.3 | 16.1 | 12.9 | 8.4 | 6.2 |
| Liquids/Solids | 6.6 | 7.6 | 6.8 | 2.8 | 2 | 3 | 4.3 | 3.6 | 1.7 | 1.3 | 1.2 |
| Activity Parameter | 1.53 | 1.83 | 2.3 | 6.7 | 7.2 | 3.3 | 3.1 | 5.9 | 9.7 | 8.2 | 6.4 |
| Relative Activity Parameter | 2.3 | 2.8 | 3.5 | 10.2 | 10.9 | 5 | 4.7 | 8.9 | 14.6 | 12.4 | 9.7 |
| Dewaxed Oil Yield, Wt. % | 58 | 53.9 | 55.3 | 75.6 | 76.9 | 75.9 | 76.1 | 77.5 | 78.1 | 78.1 | 78.2 |

Data for 4.25" diameter paddle operating at 0.5" from wall in 5.25" diameter surface chilled vessel.

Comparison of the data clearly demonstrates the positive performance advantages of paddle agitation versus the negative effects produced by increased scraper agitation. With paddle agitation at the low dewaxing aid level feed filter rate peaks at between 100 and 150 feet per minute tip speed and at the high aid level at between 50 and 100 feet per minute. In contrast, when scraper-induced agitation is employed filter rates gradually decrease to below base case levels. With the paddle the liquid/solids ratio levels out to levels below 2 at agitator speeds of between 100 and 150 feet per minute. With the scraper liquids/solids show an increase at the high aid level above 150 feet per minute and absolute values significantly higher than the paddle cases. Activity parameters (feed filter rate divided by the liquids/solids ratio) demonstrate the overall significant performance improvements caused by optimized dewaxing aid/wax interaction with peaks in the 100 to 250 feet per minute tip speed range when paddle agitation is used. Increasing scraper speed over this range produces negative results, especially at high aid dosage.

The effect of the size of the gap between the puddle and the internal chiller wall is presented in Table V. From the data it is seen that the presence of a gap significantly increases the performance of the dewaxing system. The 600N oil used in the runs reported in Table V had the following properties:

600N Oil

Typical Distillation Range, °C.: 393–582,
Feed Cloud, °C.: 57,
Viscosity, cSt @100° C.: 10.16,
Refractive Index, 75° C.: 1.4623,
API Gravity: 30.

TABLE V

EFFECT OF PADDLE TO WALL GAP WIDTH ON DEWAXING PERFORMANCE AT CONSTANT TIP SPEED USING PREDILUTION KETONE SYSTEM WITH 600 N USING THE PREVIOUSLY DESCRIBED DEWAXING AID

Constant Conditions:
Feed - 600 N
Solvent - 40/60 v/v, MEK/MIBK
Predilution - 2.3 v/v
Dewaxing Aid - 0.5% Active Ingredient (See Table I) on Feed
Vessel Diameter - 5.25" ID

| | | | | | |
|---|---|---|---|---|---|
| Paddle to Wall Gap, (in inches) | 0 | .25 | .5 | 1.0 | 1.9 |
| Gap Width as % of Vessel ID | 0 | 4.8 | 9.5 | 19 | 36 |
| Agitator Diameter | 5.25 | 4.75 | 4.25 | 3.25 | 1.45 |
| Speed (in inches) | | | | | |
| RPM | 88 | 96 | 108 | 142 | 306 |
| Ft./Min. | 120 | 120 | 120 | 120 | 120 |
| Filter Rates $m^3/m^2/day$ | | | | | |
| Feed | 8.1 | 20.5 | 19.9 | 19.7 | 14.7 |
| Dewaxed Oil | 6.9 | 16.3 | 17.1 | 16.1 | 12.2 |
| Liquids/Solids | 3.5 | 2.2 | 2.3 | 2.5 | 2.7 |
| Activity Parameter | 2.3 | 9.4 | 8.9 | 8.0 | 5.4 |
| Dewaxed Oil Yield, Wt.% | | | | | |
| No Wash | 64.7 | 71.9 | 71 | 70.5 | 68.7 |
| Wash = ½ Filter Time | 78.1 | 80.5 | 80.4 | 80.2 | 80.5 |
| Wash = Filter Time | 80.9 | 80.9 | 81 | 80.5 | 81 |

What is claimed is:

1. A method for dewaxing waxy hydrocarbon oils by chilling a mixture of waxy oil-dewaxing solvent and dewaxing aid in indirect chilling means to a wax filtration temperature wherein conditions of agitation are maintained in said indirect chilling means by means of paddles in the chilling means extending the length of the chilling means, which paddles do not touch the internal walls of said chilling means, resulting in a gap between the tip of said paddle and the internal wall of the chilling means, wherein said gap ranges from about 0.5 to about 20% of the internal diameter of said chilling means, the paddle being rotated so as to exhibit a tip velocity of about 25 to 400 feet/minute.

2. The method of claim 1 wherein the dewaxing aid is used at a dose level of about 0.01 to 1.0 weight percent active ingredient.

3. The method of claim 1 wherein the paddle tip velocity is between about 50 to 250 feet/minute.

4. The method of claim 1 wherein the paddle tip velocity is between about 50 to 100 feet/minute.

5. The method of claim 1 wherein the dewaxing aid is used at a dose level of about 0.01 to 0.5 weight percent active ingredient based on waxy oil feed.

* * * * *